US007017774B2

(12) United States Patent
Haedt

(10) Patent No.: US 7,017,774 B2
(45) Date of Patent: Mar. 28, 2006

(54) TRAY WITH BUILT IN UTENSIL

(75) Inventor: Edward L. Haedt, Oshkosh, WI (US)

(73) Assignee: Curwood, Inc., Oshkosh, WI (US)

( * ) Notice: Subject to any disclaimer, the term of this patent is extended or adjusted under 35 U.S.C. 154(b) by 361 days.

(21) Appl. No.: 10/121,092

(22) Filed: Apr. 11, 2002

(65) Prior Publication Data

US 2003/0192898 A1 Oct. 16, 2003

(51) Int. Cl.
*B65D 1/40* (2006.01)
*B65D 25/00* (2006.01)
*B65D 41/00* (2006.01)

(52) U.S. Cl. ..... 220/735; 220/574.1; 206/564

(58) Field of Classification Search ..... 220/556, 220/212, 574.1, 735; 215/228, 227, 390, 215/391; 206/564, 541; 426/115, 120
See application file for complete search history.

(56) References Cited

U.S. PATENT DOCUMENTS 1,607,864 A 11/1926 Butler
1,657,325 A * 1/1928 Suttle ..... 206/229
3,381,876 A 5/1968 Biggins
3,565,245 A 2/1971 Asher
3,704,779 A 12/1972 Nigg
3,955,742 A * 5/1976 Marshall et al. ..... 220/574
4,061,783 A * 12/1977 Hoffman et al. ..... 426/87
4,800,845 A 1/1989 Budd
5,009,310 A * 4/1991 Finney ..... 206/229
5,429,266 A 7/1995 D'Oliveira et al.
5,443,174 A * 8/1995 Bauer ..... 220/212
6,003,710 A 12/1999 Huang
6,116,450 A 9/2000 Huang
6,298,793 B1 10/2001 Turner et al.
D454,489 S 3/2002 Enciso et al.
6,412,653 B1 7/2002 Waterhouse
2002/0066738 A1 6/2002 Agarwal et al.

* cited by examiner

*Primary Examiner*—Nathan J. Newhouse
*Assistant Examiner*—Harry Grosso
(74) *Attorney, Agent, or Firm*—Curwood, Inc.; Tom J. Hall

(57) ABSTRACT

The present invention is directed to a pre-formed food packaging article, and method of manufacturing the same, useful in the packaging of individual food portions comprising a planar member having an upper surface and a lower surface, said planar member having a detachable utensil formed integrally in said planar member; and, said planar member having a sanitary membrane affixed to the lower surface covering and protecting the bottom of the utensil from contamination. The sanitary membrane of the present invention protects the lower surface of the integrally formed utensil, while a sealing film or lid protects the upper surface of the utensil, thus providing a food packaging article with a convenient, sanitary utensil for the consumer.

16 Claims, 3 Drawing Sheets

TRAY WITH BUILT IN UTENSIL

BACKGROUND OF THE INVENTION

The present invention relates generally to food packaging articles, and more specifically to preformed food containers and/or lids including an integrally formed eating utensil wherein the food containers have an outer film or membrane covering the integrally formed utensil, thereby protecting the utensil from contamination.

Preformed food containers are increasingly being utilized for packaging of individual meal kits to be consumed directly from the container. The pre-packaged food kits are desirable for the consumer due to the minimal preparation time required, ease of storage and exceptional shelf life. Additionally, since the food portions may be consumed without transfer to another container and the preformed containers are disposable, the pre-packaged food kits offer easy clean up after consuming the meal.

Manufacturers desire the ability to offer to the consumer a wide variety of foods in the pre-packaged food kits. Many foods, such as yogurt or pudding, require a utensil to extract the food from the container during consumption. Since manufacturers desire to make the meal kits as convenient to the consumer as possible, a utensil is usually provided as a separate item packed inside the container.

Providing a separate utensil and/or packing it adjacent to the food adds manufacturing costs and creates sanitation complexity. Consumers desire convenient utensils, yet want assurances that the utensil has been maintained in a sanitary and uncontaminated condition since its manufacture. This includes assurances that the utensil has not been handled or touched by other persons during the distribution of the container.

U.S. Pat. Nos. 1,607,864, 3,704,779, and 4,800,845, disclose food trays having utensils formed in the walls of the containers. However, these previous containers are not designed to be filled with food prior to distribution and further, the utensils so formed are not protected from contamination during the handling and distribution thereof.

U.S. Pat. No. 3,565,245 discloses a food container having a utensil formed in a lid for a food container. The top of the utensil may be protected by covering with a small adhesive label, nevertheless the underside of the utensil adjacent to the food becomes coated with the foodstuff, such as pudding or yogurt, and must be cleaned before the consumer can put the utensil to use. This undesirably detracts from the convenience of the utensil.

Accordingly, it is an object of this invention to provide a pre-formed food packaging article having an integrally formed utensil protected from contamination during handling and distribution, as well as from contact with the packaged food.

SUMMARY OF THE INVENTION

The present invention is directed to a pre-formed food packaging article, and method of manufacturing the same, useful in the packaging of individual food portions comprising a planar member having an upper surface and a lower surface, said planar member having a detachable utensil formed integrally in said planar member; and, said planar member having a sanitary membrane affixed to the lower surface covering and protecting the bottom of the utensil from contamination. The sanitary membrane of the present invention protects the lower surface of the integrally formed utensil, while a sealing film or lid protects the upper surface of the utensil, thus providing a food packaging article with a convenient, sanitary utensil for the consumer.

DETAILED DESCRIPTION OF THE PREFERRED EMBODIMENT

Figures 1, 4:
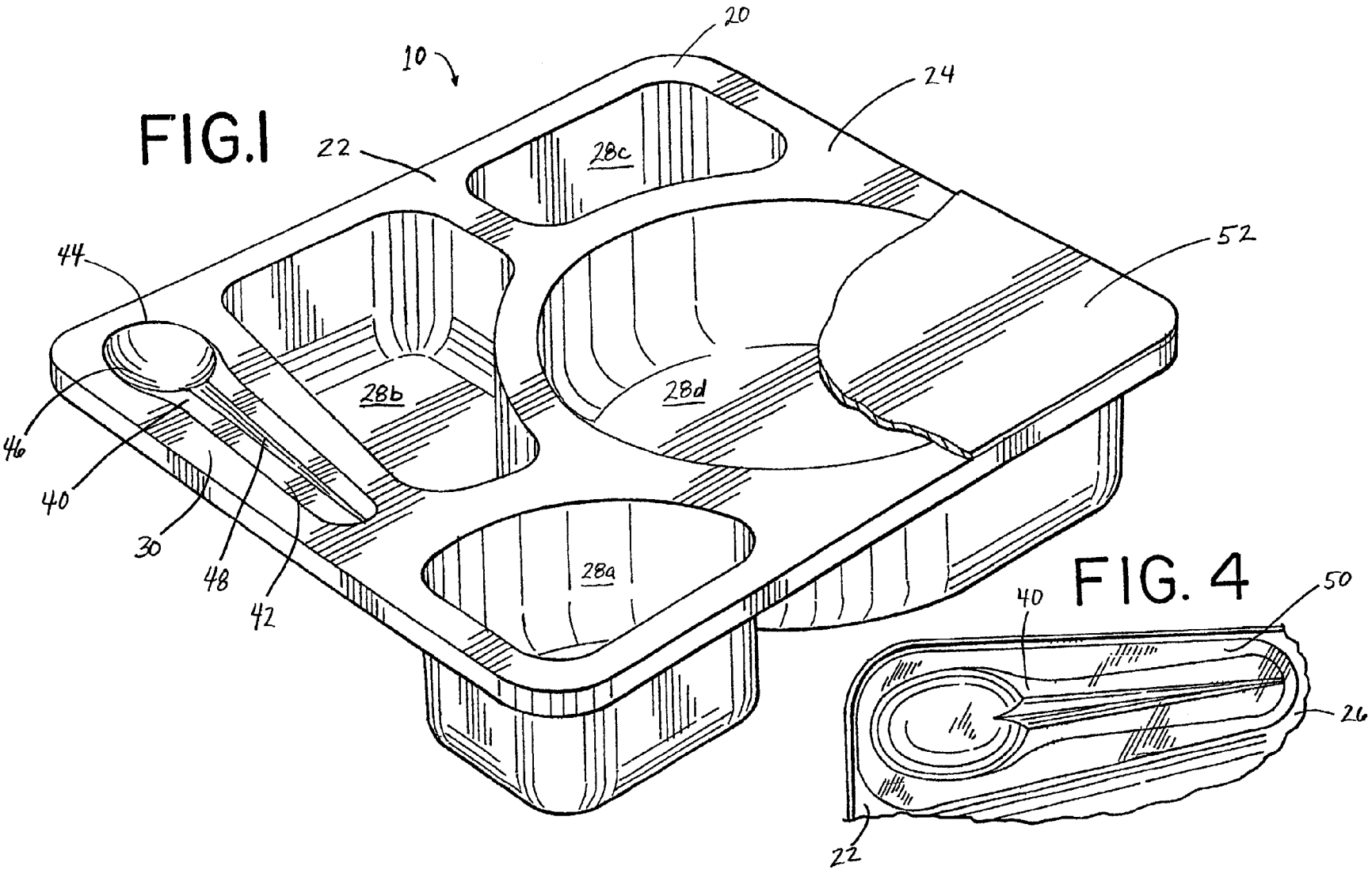
FIG. 1 is a perspective view partially broken away of a food container incorporating the features of the present invention.
FIG. 4 is a bottom view broken away of a food container incorporating the features of the present invention.
Figure 2:
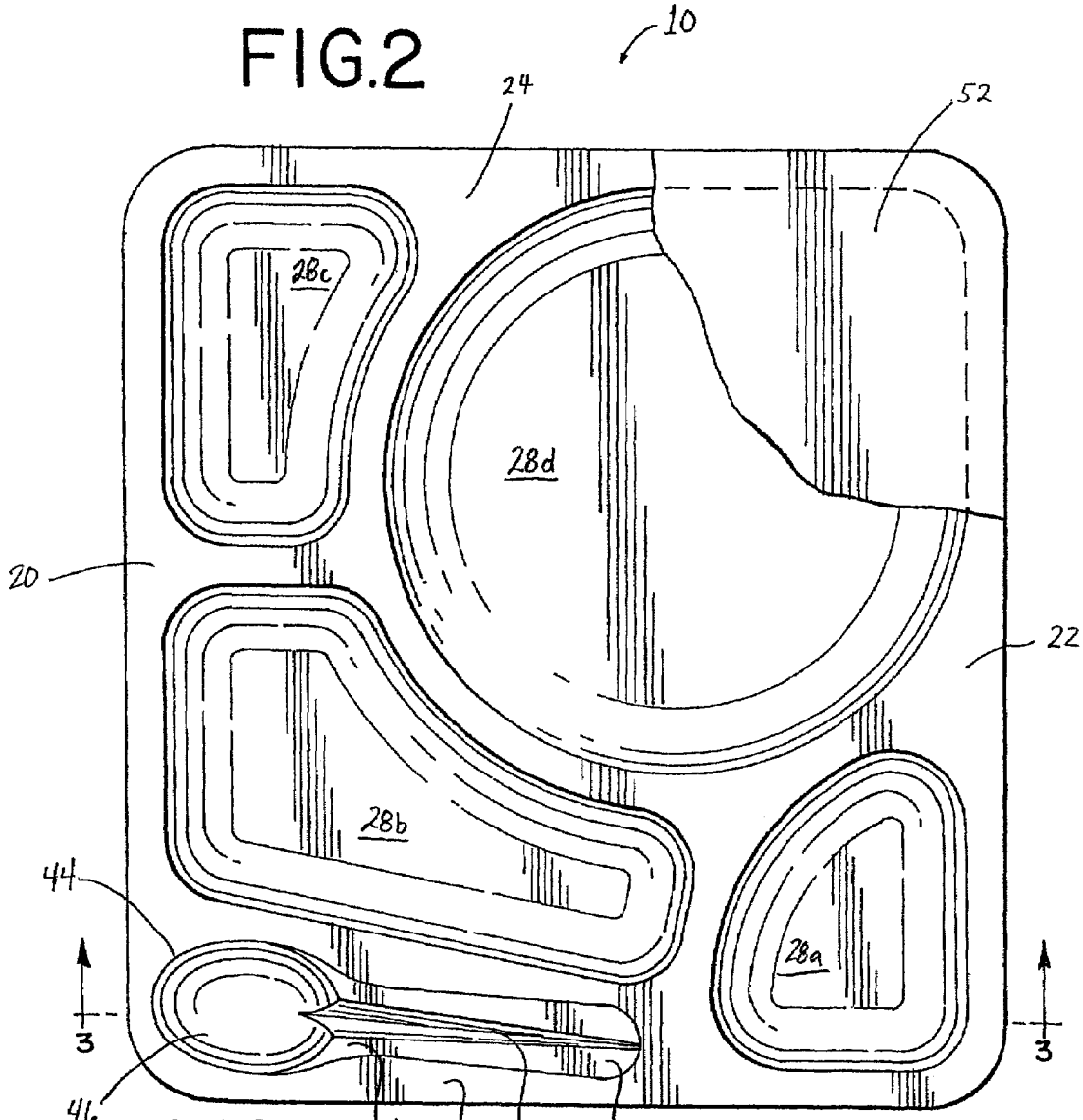
FIG. 2 is a top plan view of FIG. 1.
Figure 3:
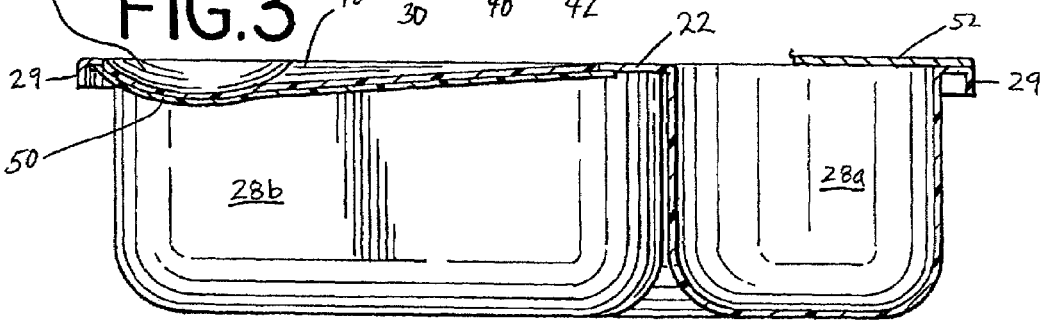
FIG. 3 is a cross section view taken along line 3—3 of FIG. 2.

A food packaging article embodying the principles of this invention is broadly designated by the numeral 10 in FIGS. 1 and 2. In this embodiment, the article 10 comprises a food-receiving and serving device in the form of a tray 20. The tray 20 includes a semi-rigid, planar member 22 defined by an upper surface 24 and a lower surface 26. The upper surface 24 includes integrally formed recesses 28*a*, 28*b*, 28*c*, and 28*d* adapted to receive and contain food items. Although the tray 20 is shown with four integrally formed recesses 28*a–d*, one will appreciate that any number, size or geometry of recesses are envisioned, or that the principles of the invention may be incorporated into a lidding structure that is coupled to or covers another food packaging article and does not include a recess.

Article 10 may be formed from sheet or film material, and preferably is formed from a thermoformable plastic film laminate described further herein. Thermoforming of plastic laminates for the production of the article 10 is preferred for its rapid and economical construction properties.

As best shown in FIG. 1, the planar member 22 includes a peripheral flange 30 which extends about the perimeter of the container 10. At least one eating utensil 40, depicted in FIG. 1 as a spoon, having a handle portion 42 and a food-engaging portion 46 is integrally formed or 'built-in' within the flange 30. Integrally formed means the utensil 40 and tray 20 are monolithically constructed or formed from the same piece of material. Preferably, the utensil 40 is formed contemporaneously with the other features of the tray 20 during a thermoforming process. Although the utensil 40 is shown formed in the peripheral flange 30, one skilled in the art will appreciate that the utensil 40 may be formed in any surface area of the planar member 22, so long as the sanitary aspects as detailed herein are adhered to. Likewise, any number of utensils may be incorporated into a food container according to the invention. The utensil 40 is shown in the form of a spoon, but may also comprise a knife or spatula, a fork, or a combination spoon with tines capable of being used as both a fork and spoon. The utensil 40 may include an annular strengthening rib 48 formed in the handle portion 42 thereof to increase the rigidity of the utensil 40.

The integrally formed utensil 40 is defined by a scored or perforated perimeter 44 that surrounds the utensil 40, thus defining the peripheral outline of the utensil 40. The scored perimeter 44 may be a continuous weakened line, such as a reduced thickness, or spaced perforations in the material, such that there is a frangible connection of the utensil 40 to the tray member 22 to facilitate the detachment and removal of the utensil 40 from the container 10.

As shown in FIGS. 2 and 4, the container 10 includes a sanitary membrane 50 affixed to a portion of the lower surface 26 of the tray member 22 enclosing and protecting the utensil 40 from the bottom surface. The sanitary membrane 50 comprises a plastic film that remains with the container 10 after the utensil 40 is removed from the top surface. The sanitary membrane 50 remains intact during packaging of food contents and distribution of the packaged product, thereby preventing unwanted touching or contamination. In this regard, the sanitary membrane 50 acts as a dirt and microbe barrier, thus ensuring the consumer has a sanitary utensil available to aid in consumption of the food.

For illustration purposes, FIGS. 2 and 4 depict the sanitary membrane affixed to the lower surface 26 of the planar member 22 in the form of a patch that may be adhered to the lower surface 26 of the planar member 22 after formation of the tray 20 and utensil 40 by conventional methods know to those skilled in the art, such as heat sealing or use of pressure sensitive adhesive, with the only requirement being that the utensil 40 should be separable from the tray 20 and that the membrane 50 remain with the tray 20.

Figure 5:
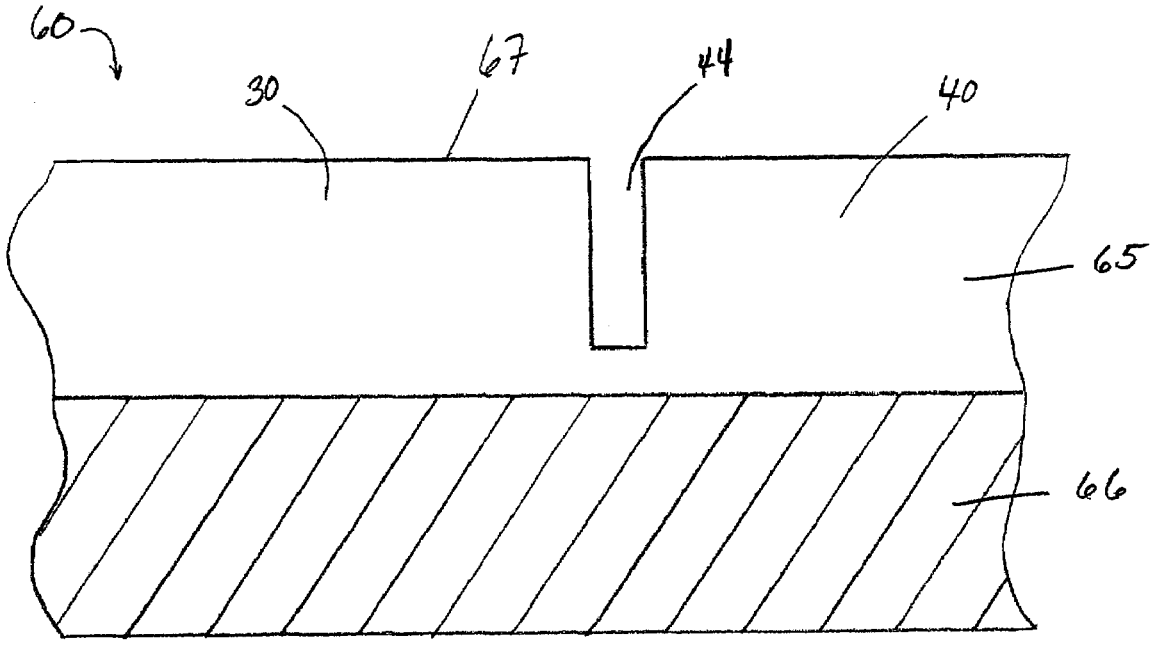
FIG. 5 is a cross section view illustrating a scored laminate embodying the principles of the present invention.

In a preferred embodiment, the sanitary membrane 50 comprises a component of a multilayer, thermoformable laminate 60 from which the tray 20 and utensil 40 are thermoformed. FIG. 5 depicts a cross section of the laminate 60 having a utensil layer 65 and a membrane or protective layer 66. The utensil layer 65 comprises a material suitably rigid enough to fabricate a useful utensil, while the membrane layer 66 is designed to provide a protective barrier for the utensil 40 from general exposure. The laminate 60 is designed such that the bond between the utensil layer 65 and the membrane layer 66 is peelable to allow the utensil 40 to separate from the membrane layer 66 and tray 20 for removal, with the membrane layer remaining intact with the tray 20. This bond may be constructed by choosing a combination of materials for the utensil layer 65 and membrane layer 66 that have natural adhesion through melt coextrusion, or other laminating/joining methods known to those skilled in the art, such as pressure sensitive adhesives.

The composition of the utensil layer 65 is only constrained by the requirement that the layer provide the mechanical properties for a useful utensil 40. Preferably, the utensil layer 65 has a thickness from about 10 to about 60 mils, depending on the materials used and the target application. In this regard, the utensil layer may comprise a multilayer material which could contain functional layers, such as barriers to moisture and gases, or include an outer surface 67 (or upper surface when referenced to the tray 20 as a whole) that could act as a sealing layer compatible with a wide variety of lidding structures. The utensil layer 65 is preferably comprised of materials or a blend of materials selected from those material conventionally used in thermoforming, such as polyvinyl chloride, polyester, copolyester, high impact polystyrene, polystyrene, polypropylene, copolymers of polypropylene, high density polyethylene, polybutylene terephthalate, styrene-butadiene copolymers, polyacrylonitrile copolymers, polycarbonate, polymethylmethacrylate, and blends or composites of the above materials including blends with other various polymeric, organic, or inorganic materials as are known to those skilled in the art. Other materials that may be included in the utensil layer 65, and particularly at the outer surface 67 position, include materials selected from the family of sealant materials such as polyolefins including copolymers of polyethylene, such as polyethylene vinyl acetate, and sealants based on coating technology such as polyvinylidene chloride and copolymers of polyvinylidene chloride, waxes, acrylics, and a wide variety of other materials known to those skilled in the art.

The composition of the membrane layer 66 is only constrained by the requirement that sanitary protection is provided to the utensil layer 66 and that it remain integrated with the food packaging article 10 after the utensil 40 is removed. The membrane layer 66 may optionally comprise a multilayer material having functional layers, such as gas and moisture barriers, or a bottom surface 68 designed for ease of printing. The membrane layer 66 is preferably from about 1 to about 20 mils thick, depending on the materials used and the targeted application. The composition of the membrane layer 66 may be selected from, but is not limited to, all the materials from which the utensil layer 65 may be selected and further including materials such as rubber-like compounds, elastomeric compounds, plastomers, etc.

In the preferred embodiment, wherein the sanitary membrane 50 is a component of the thermoformable laminate from which the article and utensil are formed, care must be taken in scoring the planar member 22 such that the utensil 40 is easily removable from the tray 20. The scored perimeter 44 may be formed by a variety of techniques known in the art, such as punch and die, steel rule, hot or cold stamping, and laser techniques that allow for weakening of the utensil layer 65 such that the utensil 40 may be easily broken away from the tray 20. The scored perimeter 44, best illustrated in FIG. 5, is formed in the utensil layer 65 and must penetrate deep enough into the utensil layer 65 such that the remaining thickness of the utensil layer 65 between the scored perimeter 44 and the membrane layer 66 is sufficiently weak to allow the utensil 40 to be readily separated from the article 10. Ideally, the depth of the scored perimeter is approximate to the thickness of the utensil layer 65, however, the depth of the scored perimeter generally needs to penetrate at least about 50% of the thickness of the utensil layer 65 and may penetrate entirely through the utensil layer 65 and into about 50% of the membrane layer 66, so long as the remaining, unscored thickness of the membrane layer 66 is sufficient to allow the membrane layer 66 to remain intact with the article 10 when the utensil 40 is removed.

After the container 10 is formed and the various compartments are filled with food, a covering lid or film 52 is sealed to the upper surface 24 surrounding each recess 28 and the utensil 40 to cover and protect the contents of each integral recess 28 and the upper surface of the utensil 40 from contamination. The lid or film covering the upper surface 24 can be made with the same or different layer of plastic as used for the tray or with a metallic foil or paper covering. Further, the lid or film covering the upper surface may be adhered by any means known to those of ordinary skill in the art. The tray member 22 optionally includes a downwardly extending rim 29 about the perimeter that is adapted to couple with a complimentary lip of a lid (not shown), thus allowing the container to be re-closed and stored for later consumption. In this regard, the utensil 40 may be replaced in the area which it was removed from and kept protected for later use.

The present invention has the advantage that it is extremely convenient to the consumer and includes a utensil that is sanitary. The utensil is maintained in place by its frangible connection to the tray until its use is required. By providing a utensil formed within the planar member 22 and not in contact with the food items, and further protected from beneath by the sanitary membrane 50, the present invention provides the consumer a convenient container with a convenient sanitary utensil that does not require cleaning before or after the meal.

The inventive method of manufacturing a pre-formed food packaging article having an integrally formed, sanitary utensil, itself, may be best understood by reference to the following description in conjunction with the above identified features.

A thermoformable laminate having a utensil layer 65 having a two-ply construction comprising a first ply of high impact polystyrene having a thickness of about 15 to 30 mils; and a second ply having a multilayer structure comprising ethylene vinyl acetate layer/tie layer/ethylene vinyl alcohol layer/tie layer/ethylene vinyl acetate polybutylene blend layer/ethylene vinyl acetate layer is supplied that acts as a semi-rigid material from which a usable utensil may be formed. A membrane layer 66 comprising a first layer of low density polyethylene and a second layer of ethylene vinyl acetate having an acetate content between 5% to 28% atomic weight is heat laminated to the utensil layer such that the bond between the utensil layer and the membrane layer are peelable i.e., peel strength between 50 grams per inch width to 800 grams per inch width. The thermoformable laminate is formed into a food container in the form of a tray and having a utensil formed integrally therewith using conventional thermoforming techniques. A score line, or other weakened perimeter, having a depth between about 50% of the thickness of the utensil layer to a depth passing through the utensil layer and about 50% of the membrane layer, is formed about and defining the perimeter of the utensil by way of punch and die, steel rule, hot or cold stamping, laser techniques or other scoring methods known generally to those skilled in the art. After the tray with utensil is thus formed, food items are inserted in the food receiving areas and a covering lid or film is affixed over the upper surface of the tray.

While a specific embodiment of the present invention has been shown and described, it should be apparent that many modifications may be made thereto without departing from the spirit and scope of the invention. Accordingly, the invention is not limited by the foregoing description, but is only limited by the scope of the claims appended thereto.

What is claimed is:

1. A food packaging article comprising:

a planar member thermoformed from a multilayer, thermoplastic laminate having a utensil layer and a membrane layer, said utensil layer and said membrane layer are contiguously and peelably bonded along an entire interface therebetween, said planar member having an upper surface formed by said utensil layer and a lower surface formed by said utensil layer of said membrane layer;

a utensil formed integrally in said planar member and detachably secured thereto, said utensil being peelable from said membrane layer; and, wherein said membrane layer remains attached to said food packaging article after detachment of said utensil.

2. The food packaging article as in claim 1, including a protective layer affixed to and overlying said upper surface and covering and protecting said utensil.

3. The food packaging article as in claim 1, wherein a score line is defined between portions of said utensil and said upper surface to facilitate removal of said utensil from said planar member.

4. The food packaging article as in claim 1, wherein said upper surface includes a plurality of integral recesses adapted to receive and contain food items.

5. The food packaging article as in claim 1, wherein said planar member includes a peripheral flange in said upper surface with said utensil formed in said flange.

6. The food packaging article as in claim 1, wherein said planar member comprises a lid structure adapted to be placed in a covering relationship with a food container, said lid structure including a covering sealed to said upper surface, whereby said utensil is covered and protected from contact.

7. The food packaging article as in claim 1, including a removable molded lid engaging said upper surface, said lid covering and protecting the contents of each recess and the upper surface of said utensil.

8. The food packaging article with integral eating utensil including:

a semi-rigid planar member defining an upper surface, a lower surface and one or more cavities adapted to receive and contain food, said planar member being thermoformed from a multilayer, thermoplastic laminate having a utensil layer and a membrane layer, said utensil layer of said utensil layer and said membrane layer are contiguously and peelably bonded along an entire interface therebetween;

a utensil formed in said planar member and removably secured thereto, said utensil being peelable from said membrane layer; and, wherein said membrane layer remains with said food packaging article after said utensil is removed.

9. The food packaging article as in claim 8, wherein said utensil is surrounded by a score line having a reduced thickness along the perimeter of said utensil to facilitate detachment of said utensil from said planar member.

10. The food packaging article as in claim 8, wherein said planar member includes a peripheral flange section in aid upper surface, said utensil formed in said flange section.

11. The food packaging article as in claim 8, wherein said planar member includes a plurality of cavities to receive and contain food items.

12. A thermoformed plastic food packaging article for packaging individual food portions, said food packaging article comprising:

a planar, semi-rigid member having an upper surface and a lower surface, said planar, semi-rigid member comprising a thermoformed multilayer, thermoplastic material having a utensil layer and a membrane layer, said utensil layer and said membrane layer are contiguously and peelably bonded along an entire interface therebetween;

at least one integrally formed food receiving compartment formed in said upper surface by a thermoforming process, said food receiving compartment having an opening at said upper surface;

at least one eating utensil integrally formed in said utensil layer of said planar, semi-rigid member, said utensil defined by a scored perimeter that permits said utensil to be detached from said container; and, wherein said utensil is peelable from said membrane layer and said membrane layer remains with said article after utensil is detached.

13. The food packaging article as in claim 12, wherein said article also includes a protective layer affixed to said upper surface covering and protecting the contents of each food receiving compartment and said eating utensil.

14. The food packaging article as in claim 12, wherein said planar, semi-rigid member includes a perimeter lip extending downwardly, said perimeter lip adapted to engage a complimentary molded plastic lid.

15. The food packaging article as in claim 12, wherein said planar, semi-rigid member includes a plurality of peripheral flange sections in said upper surface with said eating utensil formed in one of said plurality of flange sections.

16. The food packaging article as in claim 12, wherein said planar, semi-rigid member includes a plurality of integrally formed food-receiving compartments formed in said upper surface.

* * * * *